US005515826A

United States Patent [19]

Hamburg et al.

[11] Patent Number: 5,515,826

[45] Date of Patent: May 14, 1996

[54] ENGINE AIR/FUEL CONTROL SYSTEM

[75] Inventors: Douglas R. Hamburg, Bloomfield; Dennis C. Reed, Plymouth; Nicholas G. Zorka, Clarkston, all of Mich.

[73] Assignee: Ford Motor Company, Dearborn, Mich.

[21] Appl. No.: 497,328

[22] Filed: Jun. 30, 1995

[51] Int. Cl.[6] ..... F02D 41/14

[52] U.S. Cl. ..... 123/421; 123/672; 123/689

[58] Field of Search ..... 123/417, 421, 123/424, 672, 685, 686, 689, 694; 60/284, 285

[56] References Cited

U.S. PATENT DOCUMENTS

| | | | |
|---|---|---|---|
| 4,132,199 | 1/1979 | Kuroiwa et al. | 123/685 |
| 4,377,143 | 3/1983 | Hamburg | 123/672 |
| 5,211,011 | 5/1993 | Nishikawa et al. | 60/284 |
| 5,275,142 | 1/1994 | Kapellen et al. | 123/436 |
| 5,315,823 | 5/1994 | Nishikawa et al. | 60/286 |
| 5,392,599 | 2/1995 | Hamburg et al. | 60/274 |

FOREIGN PATENT DOCUMENTS

| | | |
|---|---|---|
| 54-108126 | 8/1979 | Japan . |
| 2-230934 | 9/1990 | Japan . |

*Primary Examiner*—Tony M. Argenbright
*Attorney, Agent, or Firm*—Allan J. Lippa; Roger L. May

[57] ABSTRACT

An engine air/fuel control system modulates the flow of fuel delivered to the engine with a modulation signal (100, 144) The feedback variable generated (210–228) from a two-state exhaust gas oxygen sensor (16) corrects the fuel flow (156). During each of a plurality of pre-determined intervals, the fuel flow is biased with a rich offset (342). Amplitude of the modulation signal is corrected by a difference between the feedback variable generated during two successive occurrences of the predetermined interval (346–378).

16 Claims, 8 Drawing Sheets

START

ADD MODSIG TO FV
300
READ AND STORE RPM, LOAD, ECT
302
DELAY
304
RPM LOAD, ECT +/- ΔI OF STORED VALUES?
306
N
Y
N +/- ΔI COMPARISONS ?
308
N
Y
MEASURE EGO FUND SWITCH FREQ (EGOF)
312
EGOF = MODSIG F?
314
N
Y
RPM LOAD, ECT +/- ΔI OF STORED VALUES ?
318
N
Y
INCREMENT MODSIG AMP
322
MODSIG AMP > LIMIT?
324
N
Y
GO TO DIAGNOSTICS
332
READ AND STORE FV
336
C
B

ENGINE AIR/FUEL CONTROL SYSTEM

BACKGROUND OF THE INVENTION

The field of the invention relates to engine control systems, including air/fuel control systems having adaptive learning.

Engine air/fuel control systems are known in which fuel delivery to the engine is modulated with a modulation signal having a predetermined amplitude. Such modulation causes engine air/fuel operation to alternate between values which are rich and lean of a desired air/fuel ratio. An air/fuel ratio which averages to a desired value is thereby sought. An example of such a system is shown in U.S. Pat. No. 5,211,011.

The inventors herein have recognized numerous problems with the above approaches. One problem is that the modulation signal amplitude may either be too large or too small to achieve, on average, the desired air/fuel ratio. Another problem is that feedback control is often suspended during such modulation which may result in a degradation in air/fuel operation.

SUMMARY OF THE INVENTION

An object of the invention herein is to provide air/fuel modulation in which both the modulation signal amplitude and the engine air/fuel are corrected by feedback control.

The problems of prior approaches are overcome, and the objects and advantages of the claimed invention achieved, by providing both a control method and control system for controlling the engine air/fuel ratio. In one particular aspect of the invention, the method comprises the steps of: modulating flow of fuel delivered to the engine with a modulation signal; generating a feedback variable from an exhaust gas oxygen sensor; correcting the fuel flow with the feedback variable so that engine air/fuel operation averages at the desired air/fuel ratio; changing the fuel flow a predetermined amount during each of a plurality of predetermined intervals to achieve a preselected offset in engine air/fuel ratio; providing a difference between the feedback variable generated during two successive occurrences of the predetermined interval; and adjusting the amplitude of the modulation signal in response to a detection of when the feedback variable difference exceeds a preselected value.

An advantage of the above aspect of the invention is that both correction of the modulation signal amplitude and the engine air/fuel ratio are achieved by feedback control, thereby avoiding the problems of prior approaches.

In another aspect of the invention, the control system comprises: an exhaust gas oxygen sensor with a two state output having first and second states respectively corresponding to exhaust gases being rich or lean of stoichiometry; a fuel controller delivering fuel to the engine in response to a desired fuel signal; a controller modulating the desired fuel signal with a modulation signal and averaging an output of the exhaust gas oxygen sensor to provide an air/fuel indicating signal having an amplitude related to engine air/fuel operation; reference means for providing a reference signal having a first reference value corresponding to an air/fuel ratio lean of stoichiometry during occurrence of first engine operating conditions and a second reference value corresponding to a stoichiometric air/fuel ratio during occurrence of second engine operating conditions; feedback means for integrating an error signal derived from a difference between the air/fuel indicating signal and the reference signal to generate a feedback variable, and correcting the delivered fuel with the feedback variable so that engine air/fuel operation averages at the desired air/fuel ratio; and the controller generating predetermined time intervals during occurrence of the second engine operating conditions, changing the fuel flow a predetermined amount to achieve a preselected offset in engine air/fuel ratio during each of the predetermined intervals, providing a difference between the feedback variable generated during two successive occurrences of the predetermined intervals; and adjusting amplitude of the modulation signal by increasing the modulation signal amplitude in response to a detection of when the feedback variable difference exceeds a preselected value.

An advantage of the above aspect of the invention is that feedback control maintains the average air/fuel ratio at a desired value while correcting the amplitude of air/fuel modulation.

BRIEF DESCRIPTION OF THE DRAWINGS

The objects and advantages of the claimed invention will become more readily apparent from the following detailed example and operation described with reference to the drawings wherein:

DESCRIPTION OF A PREFERRED EMBODIMENT

Figure 1:
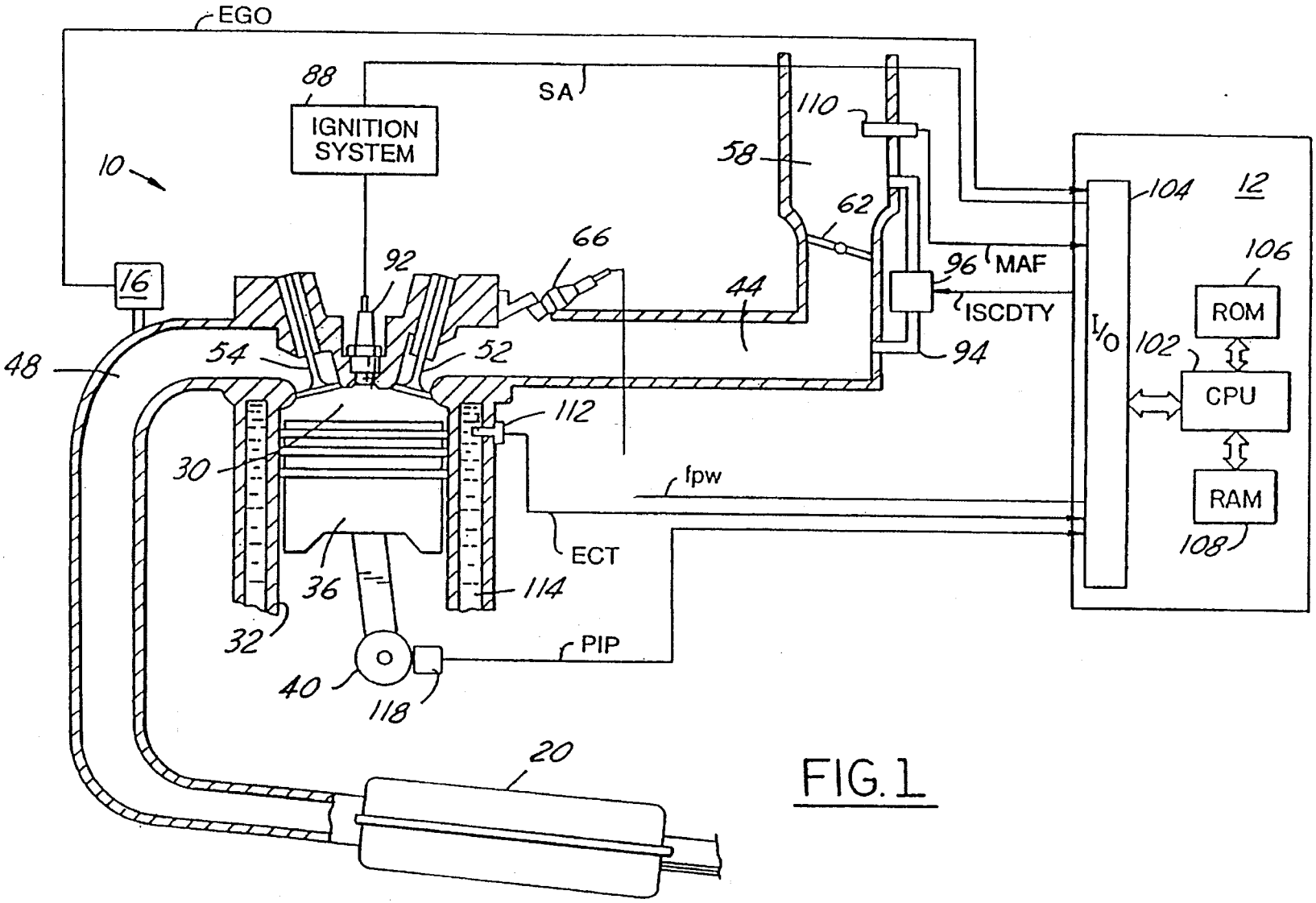
FIG. 1 is a block diagram of an embodiment in which the invention is used to advantage.

Internal combustion engine 10 comprising a plurality of cylinders, one cylinder of which is shown in FIG. 1, is controlled by electronic engine controller 12. As shown in FIG. 1, engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Intake manifold 44 is also shown having fuel injector 66 coupled thereto for delivering liquid fuel in proportion to the pulse width of signal fpw from controller 12. Fuel is delivered to fuel injector 66 by a conventional fuel system (not shown) including a fuel tank, fuel pump, and fuel rail (not shown).

Catalytic type exhaust gas oxygen sensor 16 is shown coupled to exhaust manifold 48 upstream of catalytic converter 20. Sensor 16 provides signal EGO to controller 12 which converts signal EGO into two-state signal EGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is selected as stoichiometry which falls within the peak efficiency window of catalytic converter 20.

Conventional distributorless ignition system 88 provides ignition spark to combustion chamber 30 via spark plug 92 in response to spark advance signal SA from controller 12. Idle bypass passageway 94 is shown coupled between throttle body 58 and intake manifold 44 via solenoid valve 96. Controller 12 provides pulse width modulated signal ISDC to solenoid valve 96 so that airflow is inducted into engine 10 at a rate proportional to the duty cycle of signal ISDC.

Controller 12 is shown in FIG. 1 as a conventional microcomputer including: microprocessor unit 102, input/output ports 104, read only memory 106, random access memory 108, and a conventional data bus. Controller 12 is shown receiving various signals from sensors coupled to engine 10, in addition to those signals previously discussed, including: measurements of inducted mass air flow (MAF) from mass air flow sensor 110 coupled to throttle body 58; engine coolant temperature (ECT) from temperature sensor 112 coupled to cooling sleeve 114; a profile ignition pickup signal (PIP) from Hall effect sensor 118 coupled to crankshaft 40.

Figure 2A:
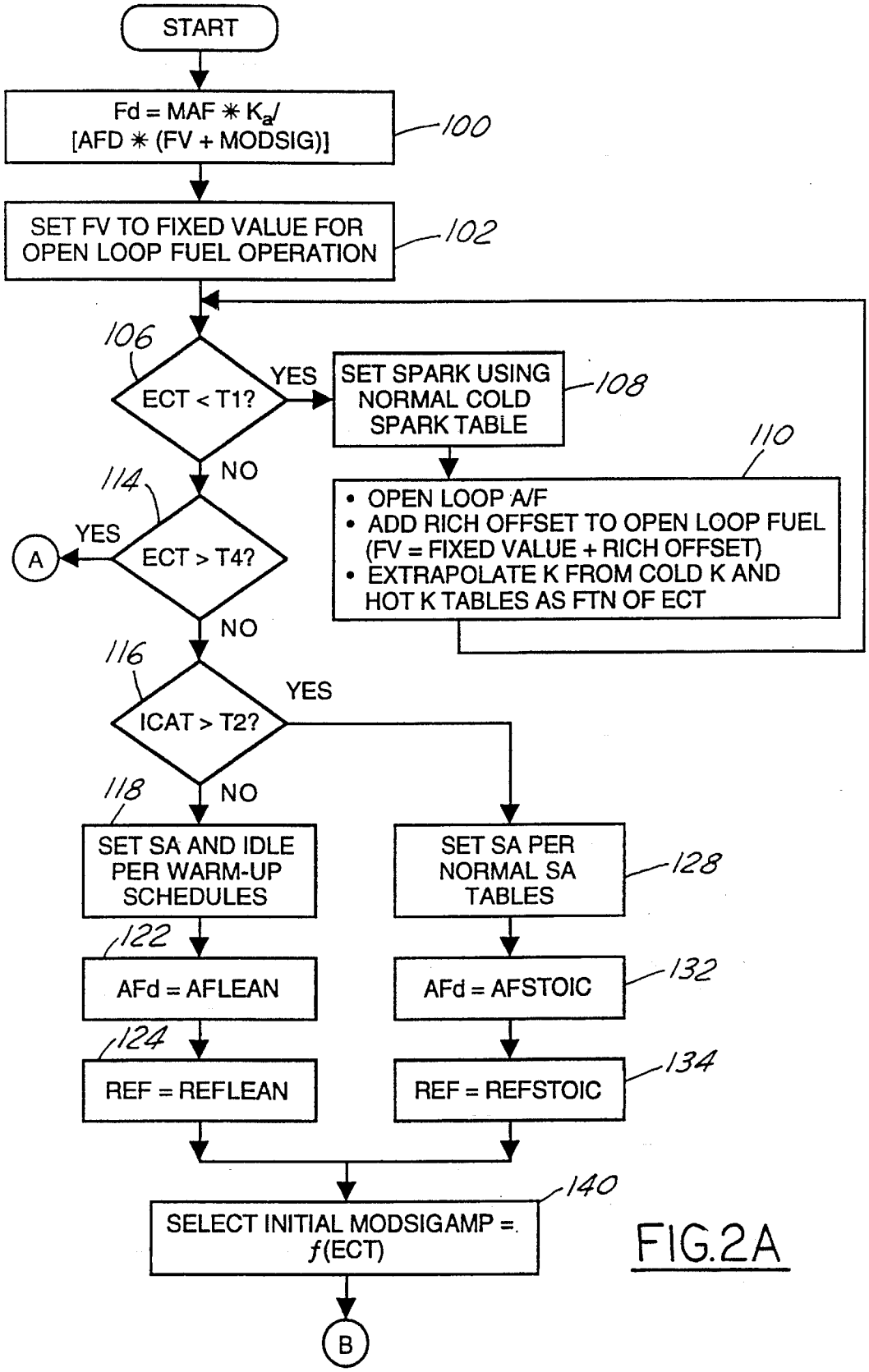
FIGS. 2A–2B are flow charts of various operations performed by portions of the embodiment shown in FIG. 1.
Figure 2B:
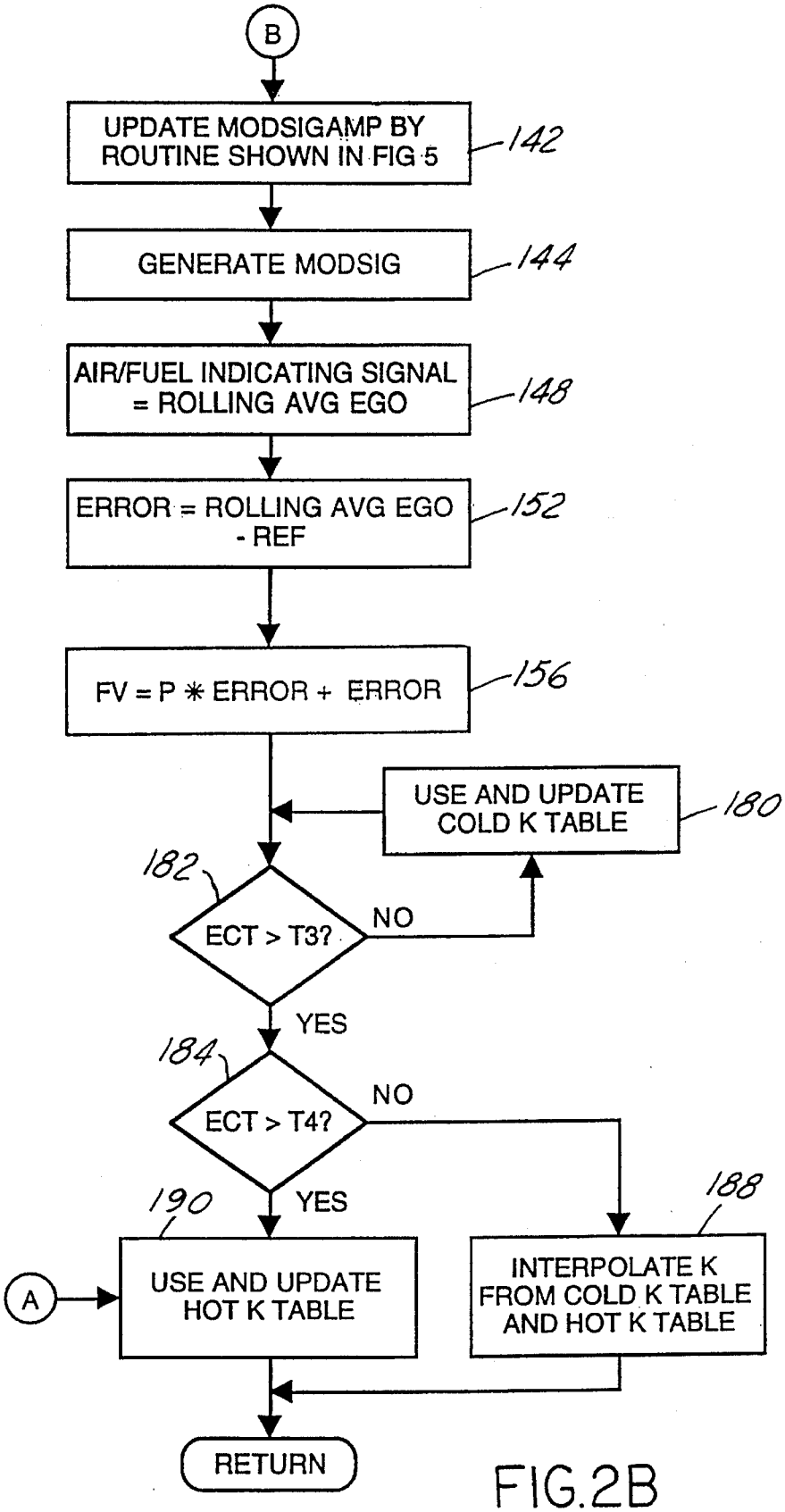

A description of various air/fuel operations performed by controller 12 is now described with initial reference to the flow charts shown in FIGS. 2A–2B. During step 100, the fuel command (shown as desired fuel quantity Fd) is calculated as shown. Desired fuel quantity Fd is first modulated by adding modulation signal MODSIG to feedback variable FV. The generation of modulation signal MODSIG is described later herein with continuing reference to FIGS. 2A–2B and the generation of feedback variable FV is described later herein with particular reference to FIG. 5. Continuing with step 100, the sum of feedback variable FV and modulation signal MODSIG is multiplied by AFD and then divided into the product of inducted mass flow measurement MAF times correction value K to generate desired fuel quantity Fd. In this particular example, desired air/fuel ratio AFD is the stoichiometric value of the fuel blend used which is 14.3 pounds of air per pound of fuel for a low emissions fuel blend.

Continuing with FIGS. 2A–2B, feedback variable FV is initially set to a fixed value for open loop air/fuel operation (step 102). Stated another way, during open loop fuel control, desired fuel quantity Fd is related to signal MAF and is not adjusted by feedback control. In this particular example, feedback variable FV is set to unity which would correspond to operation at desired air/fuel ratio AFD under ideal operating conditions without any engine component aging. It is well known, however, that this open loop operation may not result in engine air/fuel operation exactly at stoichiometry. Air/fuel control will therefore transition from open loop to feedback control as soon as practical, and, unlike prior approaches, feedback control will commence before converter 20 is fully warmed up.

Engine temperature is too low to enter the subroutine for converter warm-up when engine coolant temperature ECT is less than predetermined temperature T1 (step 106). The subroutine described with reference to steps 108–110 is then entered to minimize the time required to warm-up engine 28. In step 108, ignition timing is first set using the cold start table stored in controller 12. Various sub steps are then performed during step 110. Feedback variable FV is set to a fixed value less than unity to provide a rich offset to desired fuel quantity Fd during open loop air/fuel operation. Correction value K is then extrapolated from two tables stored in controller 12. These two tables store correction K for cold engine operation and hot engine operation, respectively. In this example, the extrapolation occurs as a function of engine coolant temperature ECT.

In the event engine coolant temperature ECT is greater than temperature T1 (step 106), it is compared to temperature T4 (step 114) which is associated with hot engine operation and normal air/fuel ratio control. If engine coolant temperature ECT is less than temperature T4, an inference of the temperature of catalytic converter 20 (ICAT) is compared to temperature T2 (step 116).

When inferred temperature ICAT is less than temperature T2, ignition timing and engine idle speed are set per the warm-up schedules (step 118) provided for rapid catalyst warm-up. That is, ignition timing is retarded from its nominal value and idle speed elevated. Desired engine air/fuel ratio AFd is set to a lean value (AFLEAN) which is lean of stoichiometry by a preselected amount as shown in step 122. In this particular example, AFLEAN is 14.6 pounds of air per pound of fuel. During step 124, reference signal REF is set equal to lean value REFLEAN which corresponds to desired lean air/fuel ratio AFLEAN.

On the other hand, if inferred temperature ICAT is greater than temperature T2, normal ignition timing and idle speed tables are utilized (step 128). Desired air/fuel ratio AFd is then set equal to the air/fuel ratio corresponding to stoichiometry (AFSTOIC) as shown in step 132. During step 134, reference signal REF is set equal to a value corresponding to the stoichiometric air/fuel ratio (REFSTOIC).

Modulation signal MODSIG is generated during steps 140–144 as a triangular wave. The amplitude of MODSIG (MODSIGAMP) is initially set as a function of engine coolant temperature ECT during step 140. As described in greater detail later herein with particular reference to FIGS. 6A–6B, amplitude MODSIGAMP is updated by an adaptively learned value (step 142). Stated another way, amplitude MODSIGAMP is corrected by the feedback routine described later herein with particular reference to FIGS. 6A–6B.

A rolling average of signal EGO is generated during step 148. Error signal ERROR is generated during step 152 by subtracting reference signal REF from the rolling average of signal EGO (152). Feedback variable FV is read from the subroutine described later herein with particular reference to FIG. 5 (step 156) wherein feedback variable FV is generated by applying a proportional plus integral (PI) controller to signal ERROR.

The operation and advantageous effects of steps 122–156 will be better understood by reviewing an example of operation with particular reference to the waveforms shown in FIGS. 3A–3E. Before discussing FIGS. 3A–3E, the description of updating the cold K and hot K tables is completed with continuing reference to FIG. 2B.

When engine coolant temperature ECT is greater than temperature T3 (step 182), but less than temperature T4 (step 184), each correction value K is interpolated from the cold K and hot K tables stored in controller 12 for each engine speed load range (step 188). In the event engine coolant temperature ECT is greater than temperature T4 (step 184), each correction value K is selected from the hot K table of controller 12 (step 190). If engine coolant temperature ECT is not greater than temperature T3 (step 182), each correction value K is selected from the cold K table of controller 12 (step 180).

Figure 3A:
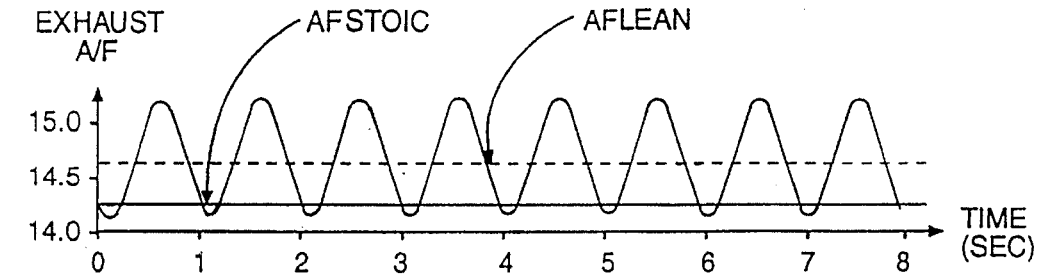
FIGS. 3A–3E illustrate various electrical waveforms corresponding to various operations performed by the embodiment shown in FIG. 1.
Figure 3B:
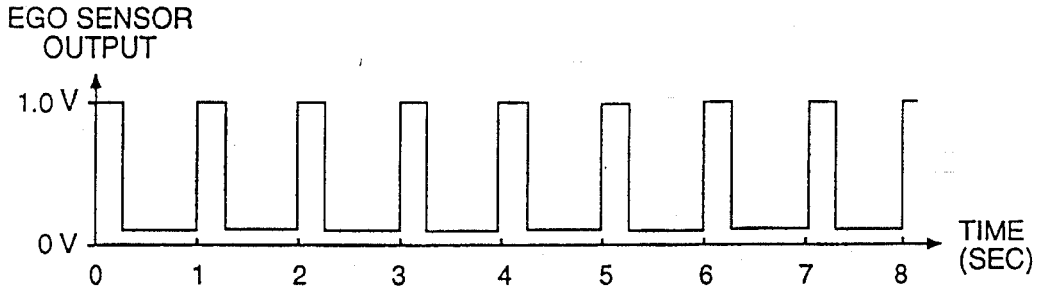
Figure 3C:
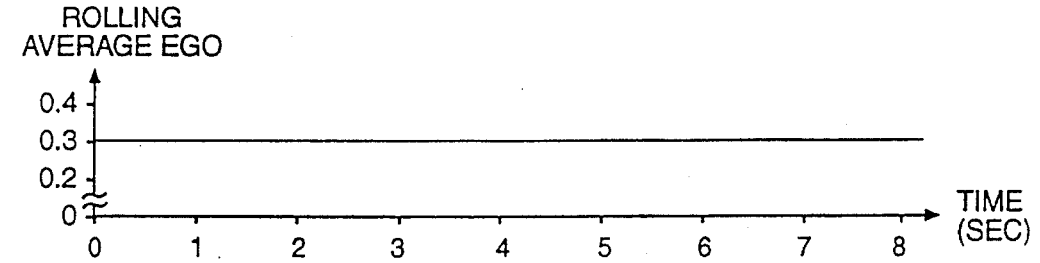
Figure 3D:
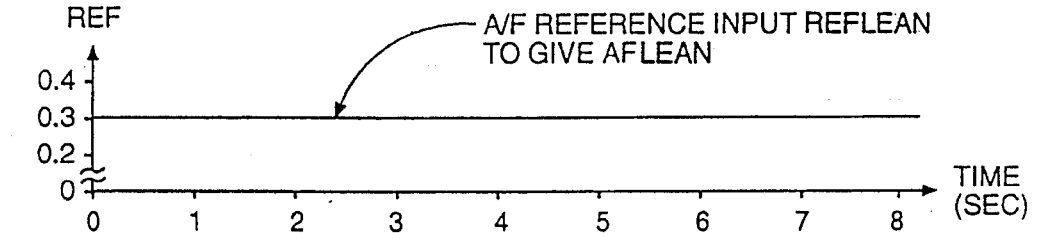
Figure 3E:
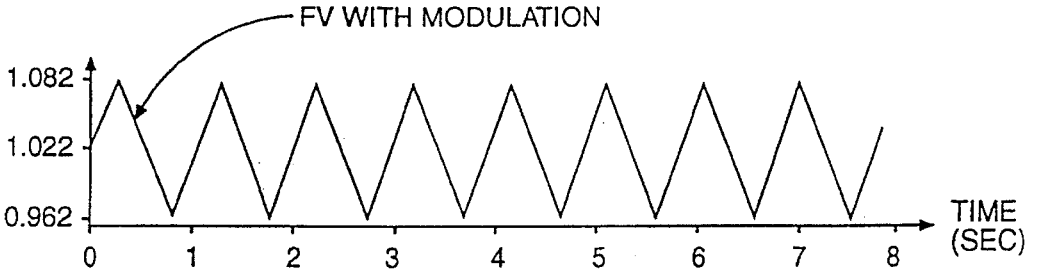

Referring now to FIGS. 3A–3E and FIG. 4, graphical representations are shown which correspond to previously described process steps 122–156. In this particular example which depicts steady state lean air/fuel operation, reference signal REF is set to lean value REFLEAN (see FIG. 3D) to provide an average air/fuel ratio lean of stoichiometry. Concurrently, feedback variable FV is modulated with a triangular wave (FIG. 3E). Such modulation occurs until an indication is provided that catalytic converter 20 has reached a desired temperature.

In this particular example, the effect of such modulation and selection of lean reference value REFLEAN provides the exhaust air/fuel ratio shown in FIG. 3A. The average value of this air/fuel ratio is shown as the dashed line labeled AFLEAN which is lean of the stoichiometric air/fuel ratio (shown as labeled AFSTOIC). The modulation and lean air/fuel offset results in signal EGO from sensor 16 as shown in FIG. 3B. A high voltage state of signal EGO is indicative of air/fuel operation rich of stoichiometry and a low voltage state is indicative of air/fuel operation lean of stoichiometry.

The rolling average of signal EGO, which is the air/fuel indicating signal, is shown in FIG. 3 C. In this example showing steady state operation, the rolling average of signal EGO (FIG. 3C) is forced to the same value as lean reference value REFLEAN (FIG. 3D).

Figure 4:
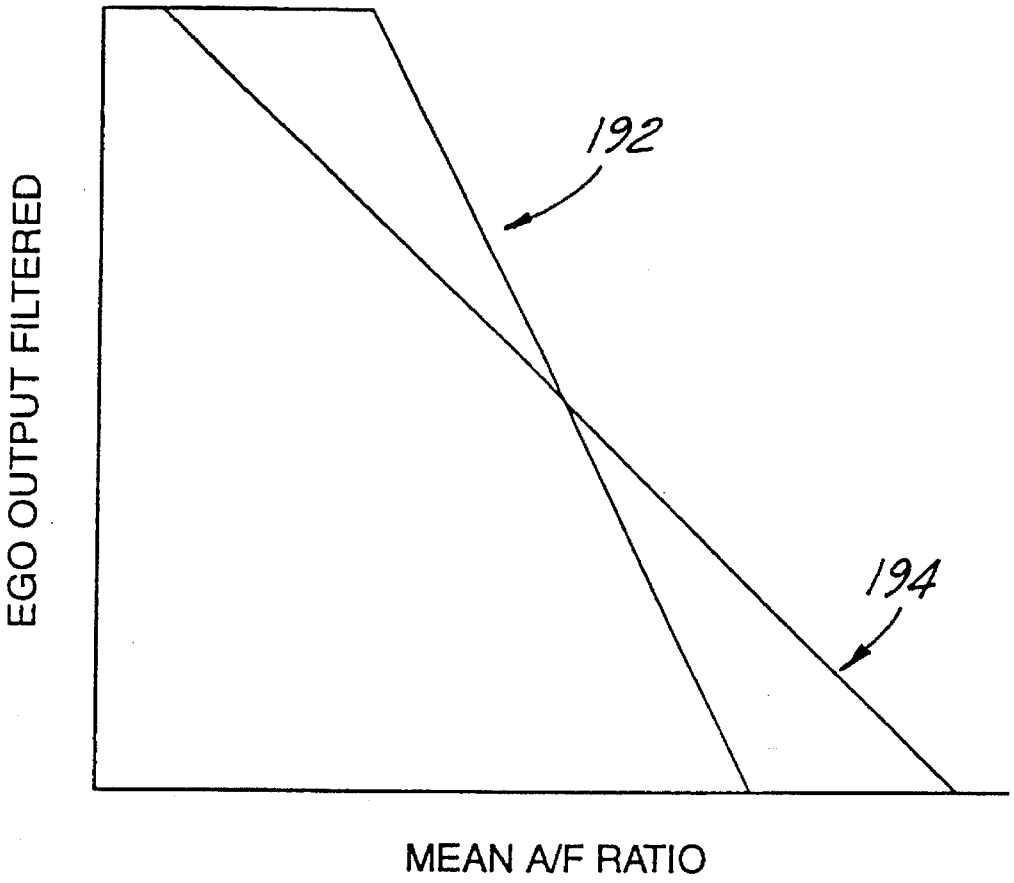
FIG. 4 is a graphical representation showing two average air/fuel indicating signals for different peak-peak amplitudes of the modulation signal.

Referring to FIG. 4, two hypothetical graphical representations of the rolling average of signal EGO in relation to the average engine air/fuel ratio are shown by lines 192 and 194. As explained previously herein with particular reference to FIGS. 2B and 3C, the rolling average of signal EGO is the air/fuel indicating signal. In the particular example shown in FIG. 4, line 192 represents the air/fuel indicating signal from a control system in which modulating signal amplitude MODSIGAMP is approximately one-half of the peak-to-peak value of the modulating signal amplitude corresponding to the air/fuel indicating signal shown in line 194. As seen in FIG. 4, the air/fuel indicating signal associated with line 192 has appreciably greater sensitivity to a change in air/fuel ratio than does the air/fuel indicating signal associated with line 194. The differences in sensitivity of the air/fuel indicating signals caused by the variations in the modulating amplitude of signal MODSIG are used to advantage in the control system described with particular reference to FIGS. 6A–6B. Before discussing FIGS. 6A–6B, the air/fuel feedback routine will be described.

Figure 5:
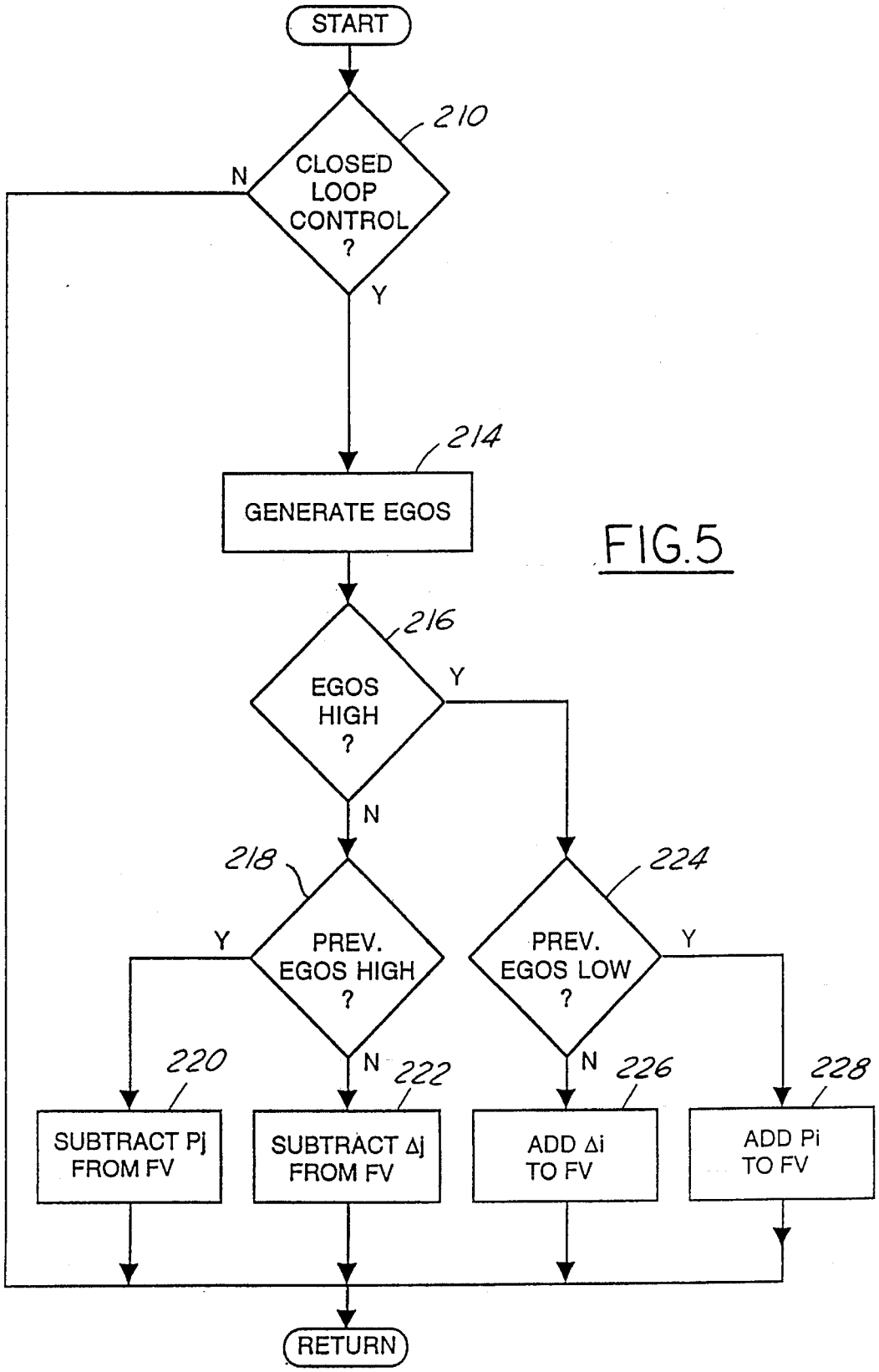
FIG. 5 is a flow chart of a portion of the feedback control described herein.

The air/fuel feedback routine executed by controller 12 to generate fuel feedback variable FV is described with reference to the flowchart shown in FIG. 5. Signal EGOS is read in step 214 after determining that closed loop air/fuel control is desired in step 210. When signal EGOS is low (step 216), but was high during the previous background loop of controller 12 (step 218), preselected proportional term Pj is subtracted from feedback variable FV (step 220). When signal EGOS is low (step 216), and was also low during the previous background loop (step 218), preselected integral term Δj, is subtracted from feedback variable FV (step 222).

Similarly, when signal EGOS is high (step 216), and was also high during the previous background loop of controller 12 (step 224), integral term Δ:, is added to feedback variable FV (step 226). When signal EGOS is high (step 216), but was low during the previous background loop (step 224), proportional term Pi is added to feedback variable FV (step 228).

In accordance with the above described operation, feedback variable FV is generated from a proportional plus integral controller (PI) responsive to exhaust gas oxygen sensor 16. The integration steps for integrating signal EGOS in a direction to cause a lean air/fuel correction are provided by integration steps Δi, and the proportional term for such correction provided by $P_i$. Similarly integral term Δj and proportional term $P_j$ cause rich air/fuel correction.

Figure 6A:
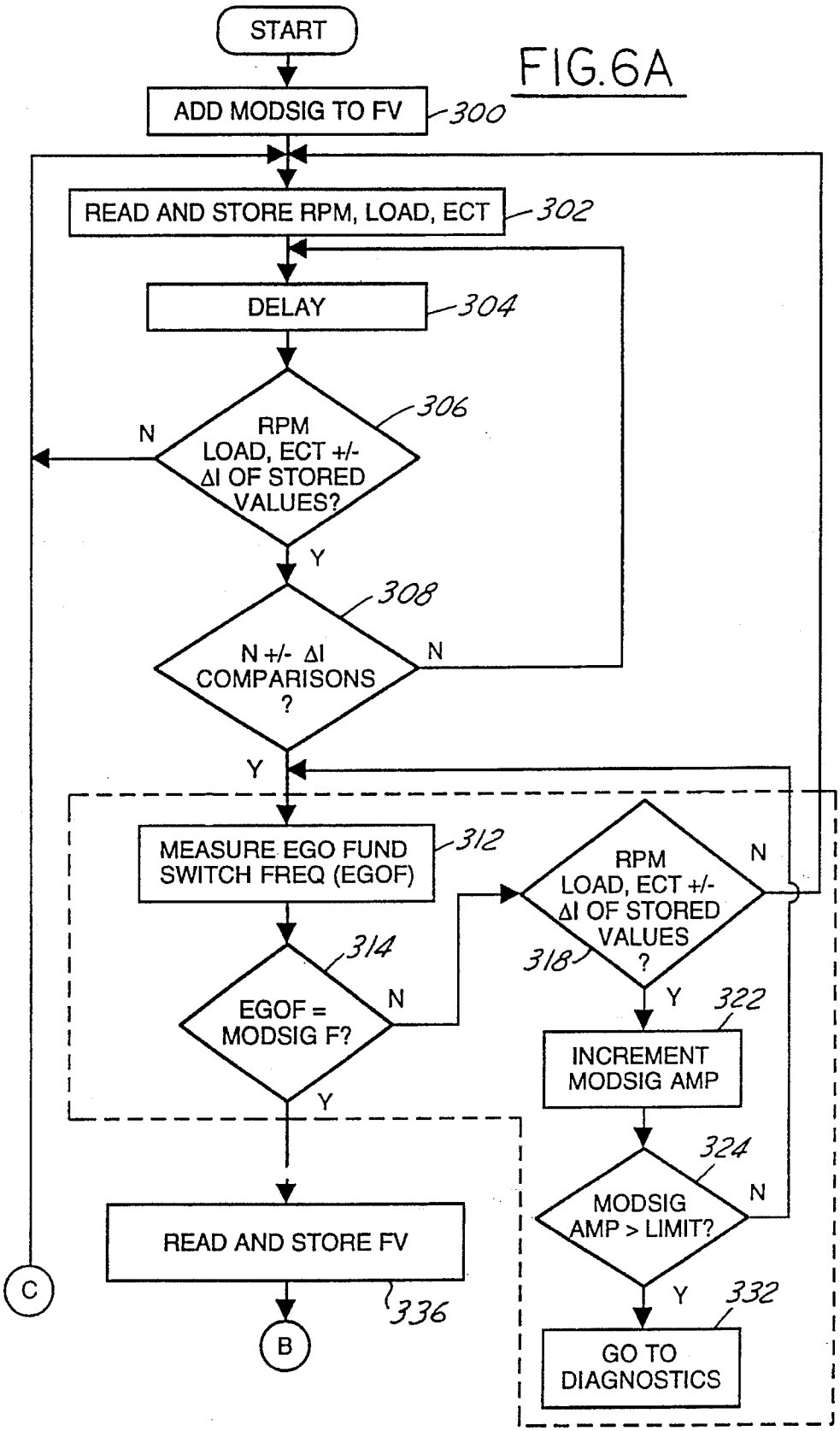
FIGS. 6A–6B show a flow chart of various operations performed by portions of the embodiment shown in FIG. 1.
Figure 6B:
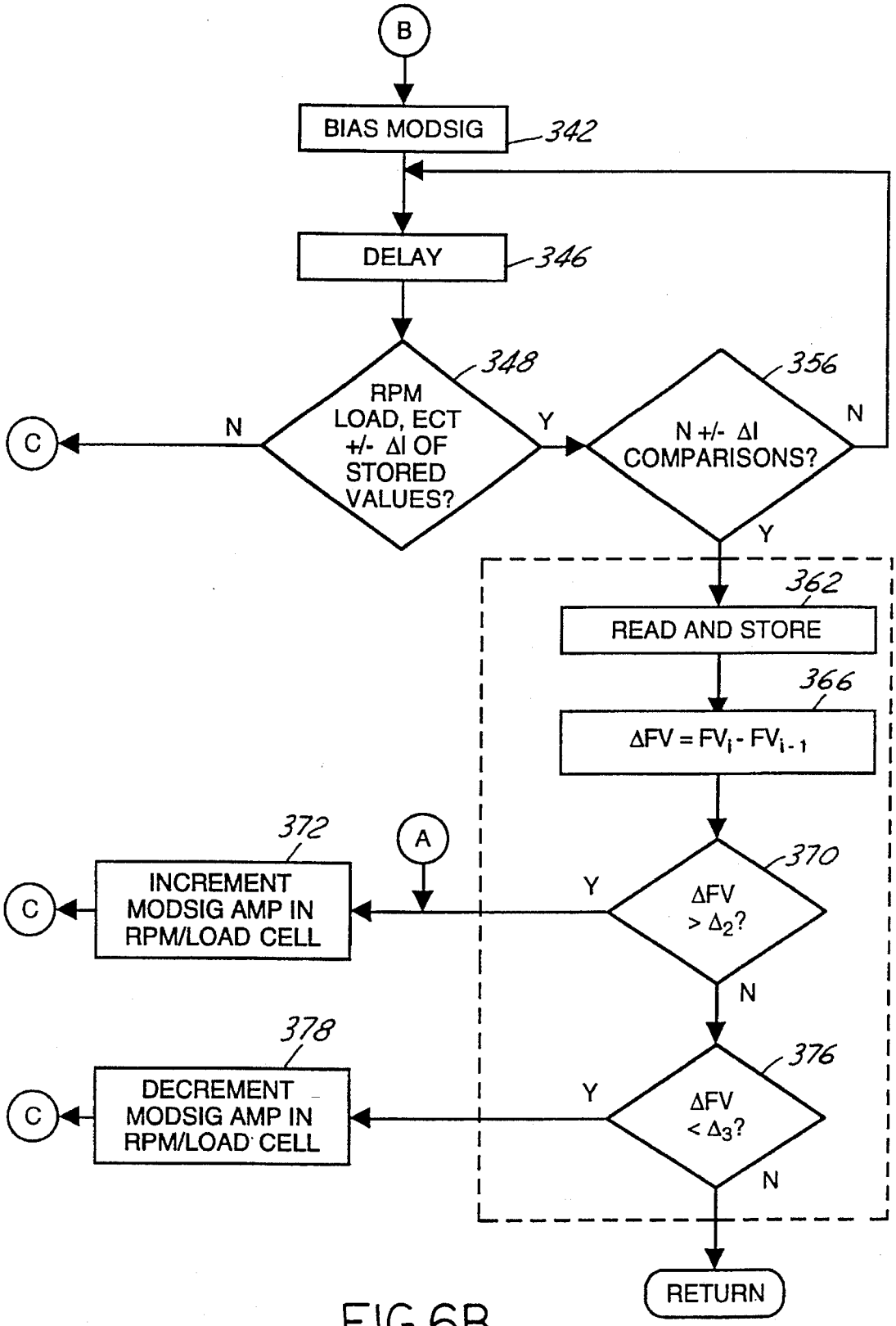

An adaptive learning system is now described with particular reference to FIGS. 6A–6B in which the modulating amplitude of signal MODSIG is adjusted via feedback control to achieve a desired sensitivity in the air/fuel indicating signal. As shown in step 300, modulating signal MODSIG is added to feedback variable FV thereby modulating desired fuel signal Fd and, accordingly, fuel delivered to engine 28 (see step 100 of FIG. 2A). Engine RPM, LOAD, and engine coolant temperature ECT are subsequently read and stored during step 302. After a delay time is provided in step 304, engine RPM, LOAD, and temperature ECT are checked during step 306 to see if they are within plus or minus Δ1 of the values previously stored in step 302. When engine RPM, LOAD, and temperature ECT are within plus or minus Δ1 for "N" successive comparisons, an indication of engine steady state operation is provided and the subroutine continues as described below (step 308). During step 312, the fundamental switching frequency (EGOF) of EGO sensor 16 is measured. If frequency EGOF is not substantially equal to the switching frequency of signal MODSIG (step 314), and engine RPM, LOAD, and temperature ECT remain within plus or minus Δ1 of previously stored values (step 318), amplitude MODSIGAMP is incremented in step 322. This increment is provided because the low frequency switching of signal EGO was probably caused by an insufficient amplitude of modulating signal MODSIG.

When amplitude MODSIGAMP is less than limited value LIMIT (step 324), the above described frequency monitoring continues until switching frequency EGOF is equal to the switching frequency of signal MODSIG (step 314). Modulating signal MODSIG is then biased or offset in either a rich or a lean air/fuel direction (step 342). In the particular example presented herein, modulation signal MODSIG is offset in a rich air/fuel direction by a predetermined bias amount during each of a plurality of predetermined time intervals. Each predetermined time interval is sufficient to enable the air/fuel offset or bias to be read by EGO sensor 16. After a delay time provided in step 346, engine RPM, LOAD, and temperature ECT are checked to see if they are within plus or minus Δ1 of previously stored values (step 348). If they are not within previously stored values, the subroutine described herein is then reinitiated.

When engine RPM, LOAD and temperature ECT are within plus or minus Δ1 of previously stored values for "N" successive comparisons (steps 348, 356), the subroutine continues. During steps 370–378, the difference in output of feedback variable FV generated between two successive predetermined intervals (generated during step 342) is computed to provide difference signal Δ FV. In the event difference signal Δ FV is greater than the value of Δ2 (step 370), the amplitude of signal MODSIG is incremented for the engine RPM and LOAD storage cell in which engine 28 is currently operating (step 372). Amplitude MODSIGAMP is increased under these conditions because it is apparent that there is too much sensitivity in the air/fuel indicating signal. Stated another way, the air/fuel indicating signal does not have a sufficient range of authority. As previously described herein, with particular reference to FIG. 4, the sensitivity of the air/fuel indicating signal is decreased by incrementing the amplitude of modulating signal MODSIG.

On the other hand, when difference signal ΔFV is less than value Δ3 (step 376), where value Δ3 is less than value Δ2, the amplitude of modulating signal MODSIG is decremented in step 378. Decrementing amplitude MODSIGAMP occurs because increased sensitivity of the air/fuel indicating signal is desired. Referring briefly back to FIG. 4, the above-described adaptive learning process may be viewed as generating an air/fuel indicating signal between lines 192 (where sensitivity is too high), and line 194 (where sensitivity is too low). In this manner, amplitude MODSIGAMP is generated using the aforesaid feedback control to provide a desired sensitivity and range of authority for the air/fuel indicating signal. Furthermore, an air/fuel indicating signal generated as described herein above provides an accurate indication of engine air/fuel ratio from a two-state exhaust gas oxygen sensor. Controller 12 thereby accurately controls the engine air/fuel ratio at any desired value.

Although one example of an embodiment which practices the invention has been described herein, there are numerous other examples which could also be described. For example, analog devices, or discreet IC's may be used to advantage rather than a microcomputer. The invention is therefore to be defined only in accordance with the following claims.

What is claimed is:

1. A control method for an engine, comprising the steps of:

modulating flow of fuel delivered to the engine with a modulation signal;

generating a feedback variable from an exhaust gas oxygen sensor;

correcting said fuel flow with said feedback variable so that engine air/fuel operation averages at said desired air/fuel ratio;

changing said fuel flow a predetermined amount during each of a plurality of predetermined intervals to achieve a preselected offset in engine air/fuel ratio;

providing a difference between said feedback variable generated during two successive occurrences of said predetermined interval; and adjusting amplitude of said modulation signal in response to a detection of when said feedback variable difference exceeds a preselected value.

2. The method recited in claim 1 wherein said adjusting step increments said modulation signal amplitude when said feedback variable difference exceeds said preselected value.

3. The method recited in claim 2 wherein said adjusting step decrements said modulation signal amplitude when said feedback variable difference is less than a predetermined value, said predetermined value being less than said preselected value.

4. The method recited in claim 1 further comprising a step of providing a two state output from said exhaust gas oxygen sensor, said two state output having first and second states respectively corresponding to exhaust gases being rich or lean of stoichiometry.

5. The method recited in claim 4 further comprising a step of averaging said exhaust gas oxygen sensor output to provide an air/fuel indicating signal having an amplitude related to engine air/fuel operation.

6. The method recited in claim 4 further comprising the steps of generating an error signal from a difference between said air/fuel indicating signal and a reference value corresponding to a desired air/fuel ratio and wherein said feedback variable is generated by integrating said error signal.

7. The method recited in claim 5 wherein said step of averaging comprises a rolling average of the sensor output.

8. The method recited in claim 1 wherein said modulation step comprises a step of adding said modulation signal to said feedback variable.

9. A control method for an engine having an exhaust gas oxygen sensor with a two state output having first and second states respectively corresponding to exhaust gases being rich or lean of stoichiometry, comprising the steps of:

modulating a flow of fuel delivered to the engine;

averaging the exhaust gas oxygen sensor output to provide an air/fuel indicating signal having an amplitude related to engine air/fuel operation;

providing a reference value corresponding to a desired air/fuel ratio;

generating an error signal from a difference between said air/fuel indicating signal and said reference value;

generating a feedback variable from said error signal;

correcting said fuel flow with said feedback variable so that engine air/fuel operation averages at said desired air/fuel ratio;

changing said fuel flow a predetermined amount to achieve a preselected offset in engine air/fuel ratio during each of a plurality of predetermined intervals;

providing a difference between said feedback variable generated during two successive occurrences of said predetermined intervals; and adjusting amplitude of said modulation signal by increasing said modulation signal amplitude in response to a detection of when said feedback variable difference exceeds a preselected value.

10. The method recited in claim 9 wherein said amplitude adjusting step comprises a step of decreasing said modulation signal amplitude when said feedback variable difference is less than a predetermined value.

11. The control method recited in claim 9 further comprising the steps of: stopping said fuel flow changing step and said amplitude adjusting steps during a predetermined engine operation; and retarding engine ignition timing from a nominal value during said predetermined engine operation to increase exhaust gas temperature.

12. The control method recited in claim 11 further comprising the steps of selecting said reference value at a value corresponding to an engine air/fuel ratio lean of stoichiometry.

13. A control system for an engine, comprising:

an exhaust gas oxygen sensor with a two state output having first and second states respectively corresponding to exhaust gases being rich or lean of stoichiometry;

a fuel controller delivering fuel to the engine in response to a desired fuel signal;

a controller modulating said desired fuel signal with a modulation signal and averaging an output of the exhaust gas oxygen sensor to provide an air/fuel indicating signal having an amplitude related to engine air/fuel operation;

reference means for providing a reference signal having a first reference value corresponding to an air/fuel ratio lean of stoichiometry during occurrence of first engine operating conditions and a second reference value corresponding to a stoichiometric air/fuel ratio during occurrence of second engine operating conditions;

feedback means for integrating an error signal derived from a difference between said air/fuel indicating signal and said reference signal to generate a feedback variable, and correcting said delivered fuel with said feedback variable so that engine air/fuel operation averages at said desired air/fuel ratio; and said controller generating predetermined time intervals during occurrence of said second engine operating conditions, changing said fuel flow a predetermined amount to achieve a preselected offset in engine air/fuel ratio during each of said predetermined intervals, providing a difference between said feedback variable generated during two successive occurrences of said predetermined intervals; and adjusting amplitude of said modulation signal by increasing said modulation signal amplitude in response to a detection of when said feedback variable difference exceeds a preselected value.

14. The control system recited in claim 13 further comprising an ignition controller for providing engine ignition timing retarded from a nominal value while the engine is operating under said first predetermined engine operating conditions to increase exhaust gas temperature.

15. The control system recited in claim 13 wherein said controller provides said modulating signal as a triangular wave and adds said modulating signal to said feedback variable.

16. The control system recited in claim 15 wherein said controller provides said modulating signal amplitude in relation to engine temperature.

* * * * *